United States Patent [19]

Scremin et al.

[11] 4,258,904

[45] Mar. 31, 1981

[54] VALVES FOR CLOSING CONTAINERS UNDER FLUID PRESSURE

[75] Inventors: Gérard A. Scrēmin, Lyons; Nino F. Urbano, Oullins, both of France

[73] Assignee: Application des Gaz, Paris, France

[21] Appl. No.: 107,243

[22] Filed: Dec. 26, 1979

Related U.S. Application Data

[63] Continuation-in-part of Ser. No. 868,153, Jan. 9, 1978, abandoned.

[51] Int. Cl.[3] ..... F16K 31/00

[52] U.S. Cl. ..... 251/339; 251/353; 222/322; 222/501

[58] Field of Search ..... 217/99; 222/322, 400.7, 222/501; 137/320, 323; 251/149.2, 149.6, 303, 339, 349, 353, 354

[56] References Cited

U.S. PATENT DOCUMENTS

| | | | |
|---|---|---|---|
| 387,802 | 8/1888 | Murray et al. | 251/303 |
| 625,114 | 5/1899 | MacSpadden | 137/223 |
| 972,860 | 10/1910 | Hoteling | 217/99 |
| 1,853,723 | 4/1932 | Crowley | 251/149.2 |
| 2,601,339 | 6/1952 | Snyder | 137/320 |
| 2,895,498 | 7/1959 | Waite, Jr. et al. | 137/320 |
| 2,936,017 | 5/1960 | McCord | 137/223 |
| 3,410,456 | 11/1968 | Johnson, Jr. et al. | 222/400.7 |
| 3,416,770 | 12/1968 | Green | 251/303 |
| 3,913,609 | 10/1975 | Remane | 137/322 |

FOREIGN PATENT DOCUMENTS

| | | | |
|---|---|---|---|
| 1915728 | 10/1970 | Fed. Rep. of Germany | 137/320 |
| 1258284 | 3/1961 | France . | |
| 12536 | of 1884 | United Kingdom | 217/99 |
| 185355 | 9/1922 | United Kingdom | 217/99 |

*Primary Examiner*—William R. Cline
*Assistant Examiner*—H. Jay Spiegel
*Attorney, Agent, or Firm*—Dowell & Dowell

[57] ABSTRACT

A valve intended in particular for closing a container of fluid under pressure, more particularly gas in the liquid and/or gaseous phase, which comprises a seat, a movable sealing valve member mounted so as to bear elastically against the said seat, an elastic element forming a spring and having a fixed portion, and another movable portion supporting the said movable valve member, is characterized in that the elastic element is a spring having a shape permitting axial and radial retraction of the movable valve member in relation to the seat.

8 Claims, 9 Drawing Figures

VALVES FOR CLOSING CONTAINERS UNDER FLUID PRESSURE

Figure 1:
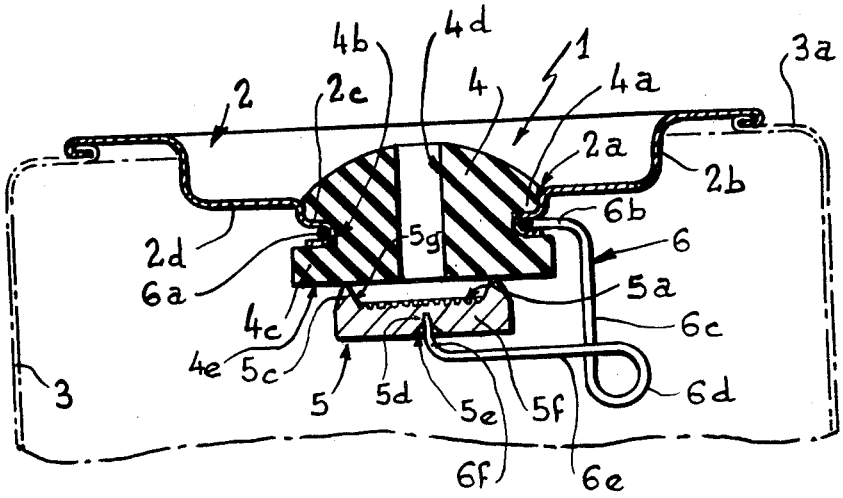

This application is a continuation-in-part of Ser. No. 868,153, which is now abandoned.

The present invention relates to improvements made to valve devices intended in particular for closing a container of fluid under pressure, for instance gas in the liquid and/or gaseous phase, which valve device can permit in particular the easy dispensing of the said fluid and also the filling of the container.

A device of this kind is more particularly, although not exclusively, intended to be associated with a gas cartridge or aerosol can.

In French Pat. No. 1,258,284 a valve of this kind is described which comprises firstly a metal seat disposed in the top part of a container, secondly a sealing valve mounted to bear elastically against the said seat and consisting of a metal cup in which a seal is disposed, thirdly an elastic metal blade or element forming a spring and having a fixed portion fastened to the wall of the container, and another movable portion supporting the valve and causing the latter (or more precisely its seal) to bear against the metal seat.

A valve of this kind has a certain number of disadvantages, including the fact that the shape of its spring does not enable the valve to open wide, and that this spring must obligatorily be fixed flat to the top end piece of the container.

It is also described a valve of the kind according to the invention in U.S. Pat. No. 625,114, its valve member is supported on a spring which either comprises a flat band-like member or alternatively comprises two adjacent wires. In either case, however, the spring is constructed such that it can only serve as a hinge, allowing the valve member to move in the plane of the loop of the spring but resisting motion of the valve member radially to either side of that plane. Moreover in that patent no tool is inserted through the passage of the valve. The valve plate member therefore only needs to be raised off of the seat when air pressure is forced through the passage. In the above U.S. Pat. No. 625,114, the parallelism between the valve plate member and the seat can be achieved only by bending the spring very carefully to provide such parallelism; nevertheless, in use this parallelism necessary to the fluid-tightness cannot last very long.

In another U.S. Pat. No. 3,913,609 it is seen a valve arrangement but it is totally different from the present invention. It is shown a metallic seat and a movable member integral with the structure which resiliently urges it toward the seat. The fluid-tightness of such an arrangement may be difficult in use.

It is also known another U.S. Pat. No. 2,601,339 which relates to a yieldable valve member which is only displaceable about a pivot axis which does not permit the operation thereof in any direction to said axis.

On the contrary according to the invention the movable valve member which lies against the seat on the seal is held against the seat only by a single wire spring member, whereby the movable valve member can be displaced radially away from the axial passage by way of the spring which is yieldable in radial or lateral direction as well as in axial direction.

An important feature according to the invention concerns the ball-joint junction between the spring and the valve member which allows the later to tilt at a steep angle so that a tube can easily pass it without requiring the spring to bend so shaply in the vicinity of the valve member as to cause possible damage to the spring, or at least bending thereof to assume an undesired shape.

This ball joint type connection makes it easier for the valve member to be displaced radially in a manner to permit the tube to completely pass it. Moreover, the ability of the valve member to pivot where it joins the spring also provides the valve member with the ability to lie perfectly flat on the seat, even after numerous apertures of it, and thereby assume the optimum position for sealing the gas within the container. Accordingly, the ball joint effect performs at least three very useful functions. It permits the valve member to tilt sufficiently to throw the valve member to one side in a radial displacement so as to permit the tube to completely pass it. It permits the valve member to retreat from the tube without overstressing the steel spring during such displacement. It frees the valve member to assume optimum sealing position on the face of the elastomeric seat. As a result, the loading of the spring on the valve member is always in an axial direction, and it is unnecessary to provide narrow manufacturing tolerances, since the parallelism between the seat and the valve member is never in error.

Moreover, the axial passage of the seal can have a bead in the inward axial direction and constricts that passage. This permits a tube to be moved diagonally from the axial passage through the seal so as to place the tube in one corner in the bottom of the container.

The improvements which form the object of the present invention permit the construction of a three-piece valve, particularly for a pressurized container, which will comply better than hitherto with the various practical desiderata. The invention relates in particular to a valve whose seat closes the opening of a container and through which either a gas extraction means or a push-rod for filling the container can be passed.

The accompanying drawing, which is given by way of example, will enable the invention, the characteristics which it possesses, and the advantages which it can provide to be better understood.

Figure 2:
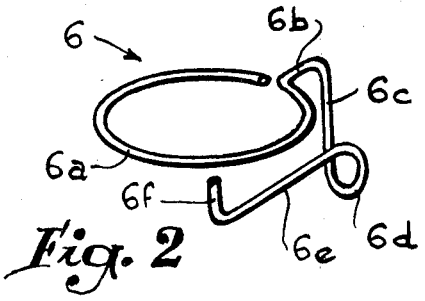
Figure 3:
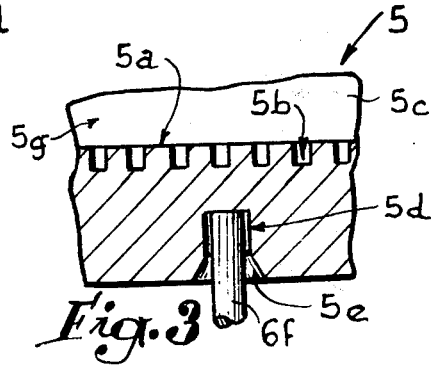
Figure 4:
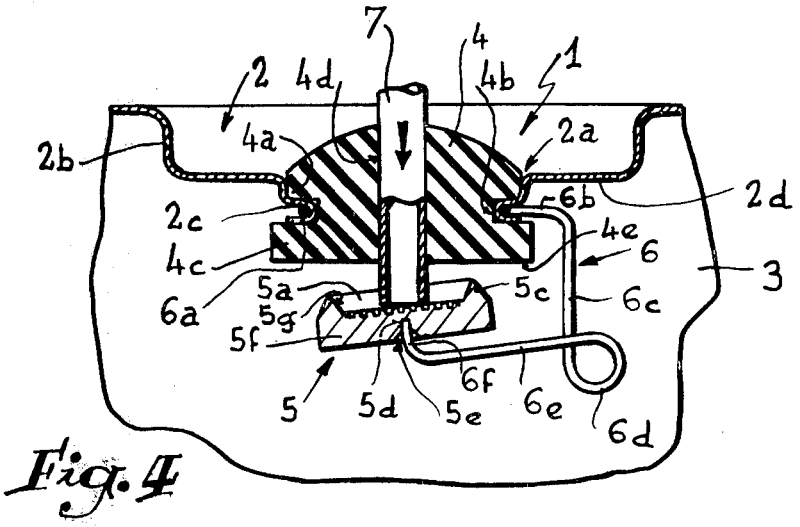
Figure 5:
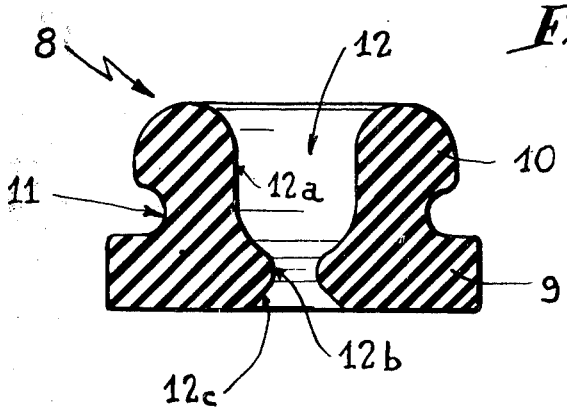
Figure 6:
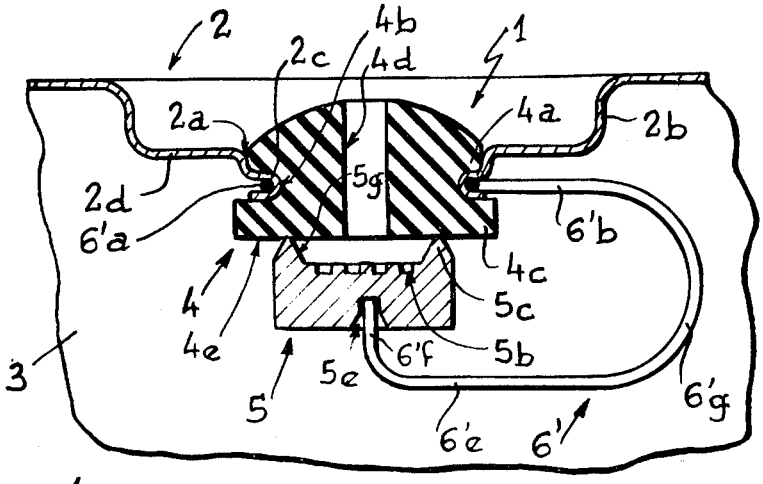
Figure 7:
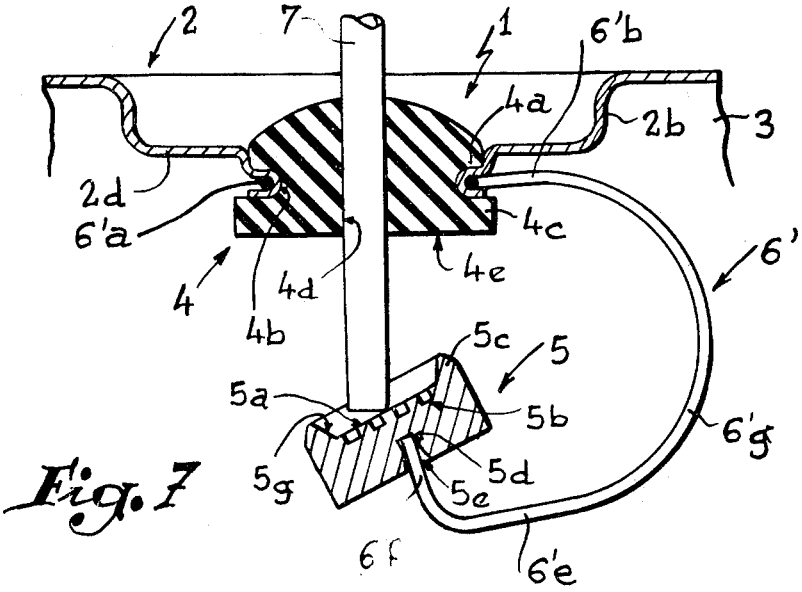
Figure 8:
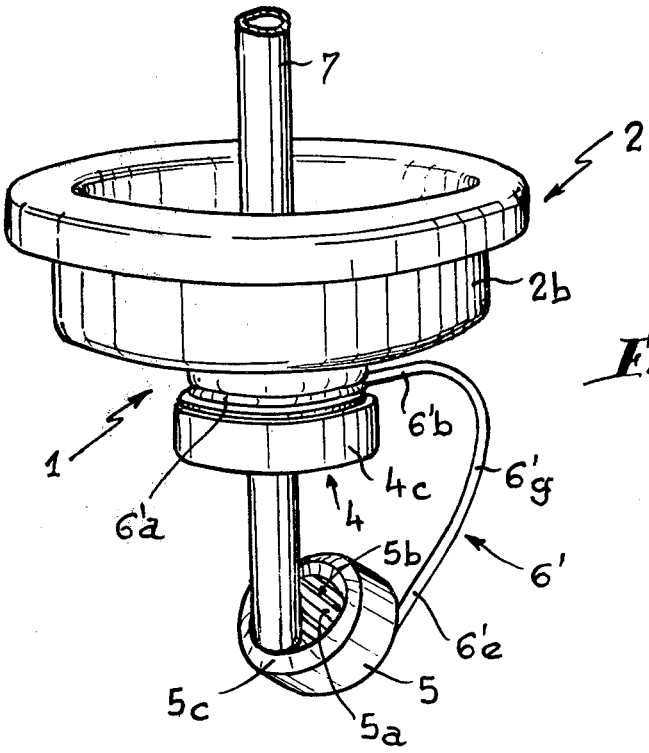
Figure 9:
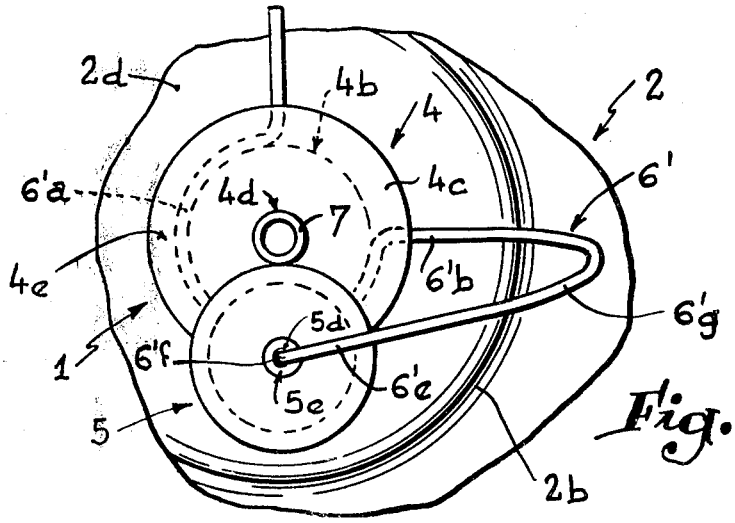

FIG. 1 is a cross-section of a valve constructed in accordance with the invention, in the closed position, FIG. 2 illustrates a shape of the spring acting on the movable member of the valve shown in FIG. 1, FIG. 3 is a section on a very large scale of the movable valve member shown in FIG. 1, showing on the one hand its face cooperating with the gas extraction means, and on the other hand the manner in which it is associated with the corresponding end of the spring, FIG. 4 is a similar view to FIG. 1 but shows the valve in the open position, FIG. 5 is a cross-section of a preferred construction of the seal of the device according to the invention, FIG. 6 is a similar view to FIG. 1 but illustrating a preferred form of the spring, FIG. 7 shows the beginning of the opening of the valve member when a tube penetrates axially into the seal member, FIG. 8 is a perspective view similar to FIG. 7, but illustrating the next step of the opening, FIG. 9 is a bottom view showing the valve member completely offset with respect to the seal member when the tube is fully inserted through the valve.

FIG. 1 shows a valve device 1 according to the invention, which is placed in the central aperture 2*a* of the sheet metal cup 2 of a container 3, part of which is shown in dash-dot lines.

The cup 2 has a circular depression 2*b* in the center of which the opening 2*a* is provided. The latter is bordered by a rolled edge 2*c* situated below the level of the horizontal bottom 2*d* of the cup 2.

A seat or seal 4 made of elastic material, such as for example a synthetic or natural elastomer, is engaged by a force fit in the opening 2*a* in the cup. This seat has a cylindrical portion 4*a* whose upper face is curved and in which a peripheral groove 4*b* is provided. The bottom of the seat 4 is in the form of a cylindrical base 4*c* whose diameter is greater than that of the cylindrical portion 4*a*. A longitudinal central passage 4*d* is in addition provided in the seat 4.

The seat being engaged by a force fit in the opening 2*a* of the cup, the rolled edge 2*c* of the latter is sealingly engaged in the groove 4*b* of the seat 4, while its cylindrical base 4*c* cooperates with the inner bottom face of the rolled edge 2*c*.

The other parts constituting the valve of the invention are a movable valve member 5 mounted so as to bear elastically against the seat 4, and a spring 6 intended to act on this movable valve member.

The spring 6 is made in the form of a funicular element of circular section, comprising an unclosed upper ring 6*a* adapted to be engaged elastically inside the rolled edge 2*c* (FIG. 1), one end of the said ring being extended by a horizontal portion 6*b* followed by a first downwardly directed branch 6*c*; at the end of this branch at least one loop 6*d* is formed which is continued by a second, horizontal branch 6*e* provided with a short vertical end 6*f* the axis of which is concentric to the ring 6*a*.

It will be realized that a spring of this kind can be substantially deformed so as to permit axial and radial retraction of the movable valve member 5 in relation to the seat 4, this being of considerable interest because losses of head of the gas flow can thus be practically eliminated, as will be more fully explained later on. Furthermore, because of the retraction of the valve with the aid of a bent extraction element it is possible to extract the gas either in the gaseous phase or in the liquid phase when the container is recumbent. Moreover, the radial equiresistance of the metal wire constituting the spring ensures axial centring of the movable valve member in relation to the seat. Obviously, the spring could have a different general shape provided that it permits the axial and radial retraction of the movable valve member.

The movable valve member 5, which is in the form of a circular disc, comprises on the one hand a central portion 5*f* serving as support face for the extraction tube 7 (FIG. 4), and on the other hand a peripheral lip 5*c* which projects slightly in relation to the portion 5*f* providing the seal between the member 5 and the seat 4. The central portion 5*f* is provided with an upper face 5*a* (FIG. 3) provided uniformly with fine grooves 5*b* of rectangular profile and directed parallel to one another. It is thus unnecessary to provide lateral apertures on the extraction element 7 which is driven into the passage 4*d* in the seat 4, since the gas can arrive at the mouth of the bottom aperture of the tube 7 by passing through the channels formed by the grooves in the movable valve member, or inversely in the case of filling.

Provision is made for giving the central grooved portion 5*f* of the movable valve member 5 a substantially larger diameter than that of the extraction element 7, so that any eccentricity that may occur after fitting or in the course of operation between these two elements 5 and 7 will have no effect on the correct operation of the valve. The peripheral lip 5*c* (FIG. 1), which projects slightly upwards in relation to the face 5*a* and whose cross-section has an ogival shape with a section increasing progressively in the downward direction, consequently forms a circular edge intended to come into contact with the bottom face of the seat 4.

In this manner, despite the relatively large surface of the movable valve member, the specific pressure of the latter against its seat remains great.

The movable valve member is provided with a central blind hole 5*d* in which the end 6*f* of the spring 6 can engage with a certain clearance, this hole being extended downwards by a radially widened portion 5*e*. A ball joint effect is thus created for the movable valve member 5, enabling the latter to cooperate fully with the seat 4.

As shown in FIG. 4, when the extraction element 7 (which may moreover also be a filling tube) is driven downwards in the passage 4*d* the action of the bottom end of this element 7 on the grooved face 5*a* of the movable valve member 5 enables the latter to be positioned sufficiently obliquely in relation to the horizontal to uncover a substantial portion of the mouth of the said elememt 7 thus considerably reducing the losses of head of the gas, as previously indicated above.

FIG. 5 shows a preferred form of the seal associated with the movable valve member of the invention. This seal which is made of a synthetic or natural elastomer, has been given the general reference 8. Above its base 9, which is made in the same manner as the base 4*c* of the seal 4 previously described, it is provided with a rounded head 10. At the junction of these two elements is situated a groove 11 intended to receive sealingly the rolled edge 2*c* of the cup 2. The head 10, which has a diameter slightly smaller than that of the base 9, thus constitutes a kind of annular bead because of the presence of the central longitudinal passage 12 intended for the passage of the tube 7.

The passage 12 has the shape of a tulip 12*a* widened out towards the top, its bottom portion having a constriction 12*b* which leads into the base of a frustoconical 12*c* opening out in the downward direction. Thus, when the tube 7 passes through the passage 12, sealing is effected at the constriction 12*b*, which is compressed centrifugally so that its reaction will vigorously apply its periphery against that of the tube, acting like an O-ring.

According to a preferred embodiment illustrated in FIG. 6, the spring now referenced 6′, does not comprise the loop 6*d*. This spring comprises a curved portion 6′*g* which connects its portions 6′*b*, 6′*e* corresponding to the portions 6*b*, 6*e* of the spring 6. The spring 6′ has also a ring-shaped portion 6′*a* adapted to be engaged resiliently inside the rolled edge 2*c* and a short vertical end 6′*f* the axis of which is concentric to the axial passage 4*d* of the seal 4. This end 6′*f* penetrates with clearance into the blind hole 5*d* of the valve member 5, to create a ball joint effect as indicated above with reference to FIG. 3.

As already mentioned, the spring has such a shape that it is yieldable in the axial direction, as well as in any radial direction to said axial direction. At the beginning of the insertion of the tube 7 through the axial passage 4*d* of the seal 4, the valve member 5 is moved off of the seat. During that movement the spring 6′ which only holds the valve member 5 against the seal 4 is displaced in its own plane which contains the geometric axis of the passage 4*d* of the seal 4. The same operation takes place in the FIG. 8 which further shows the insertion of the tube 7 tilting the valve member 5 on the end 6'*f* and riding toward the annular inner edge 5*g* of the lip 5*c*.

When the tube is still further inserted toward the bottom of the container 3 of which the valve assembly would be a part, such further insertion still pushes the valve member 5 which moves laterally and/or radially and finally escapes the action of the tube. At that time the spring urges the valve member toward the seat 4 with which it comes in engagement through its lower side 4*e*.

It is understood that the operation of the valve comprising the spring 6 is exactly the same.

The spring 6—6' is so shaped that it yields radially or laterally with respect to the axial passage 4*d* of the seal member 4 when the long tube 7 is inserted, thereby completely preventing the valve member from partially blocking the end of the tube, and also protecting the valve member from damage by a rod or the like which might be inserted at such an angle as to tend to break the spring.

As a matter a fact, the radial displacement possibility of valve member 5 results on the one hand from the circular cross-sectional shape of the spring so that its has substantially equiresistance to displacement of the valve member in radial direction and on the second hand from the large curved intermediate portion connecting part 6*b*, 6'*b* to part 6*e*, 6'*e* of the said spring.

A three-piece valve has thus been produced whose cost price is very low and which nevertheless has a large number of technical advantages over similar devices existing on the market.

It should in addition be understood that the above description has been given only as an example and that it does not in any way limit the scope of the invention, which will not be departed from by replacing the details of construction described by any other equivalent detail. In particular it is obvious that the tue 7 could be bent instead of straight as shown.

We claim:

1. A valve device for mounting in an aperture through a supporting member, the valve device being openable for the outward withdrawal of fluid under pressure by insertion of a tube inwardly therethrough, the valve device comprising:

a seal member closing said aperture and having an axial passage extending therethrough, and having an inwardly facing seat extending around said passage;

a moveable valve member having one face disposed to lie against said seat and close said passage in fluid-tight engagement and having an opposite surface including a blind hole extending therethrough toward said one face;

a spring having a first end portion fixed with respect to said seal member and said supporting member and having a second end portion extending toward said axial passage concentrically therewith and engaging the valve member by entry into said blind hole, the spring comprising the sole means to yieldably locate and position and bias the valve member against said seat, the spring between said end portions comprising a single wire of substantially circular cross-section including at least a curved intermediate wire portion joining said first end portion to said second end portion, the spring being yieldable about said intermediate portion to permit displacement of the valve member both inwardly away from the seat and also laterally in any radial direction with respect to said passage when a tube is inserted through the passage.

2. A valve device as claimed in claim 1, wherein the spring between said end portions comprises said intermediate wire portion which extends in the axial inward direction past said seal member and away from said first end portion and beyond said movable valve member and which then curves around and extends concentrically toward said axial passage to join the second end portion.

3. A valve device as claimed in claim 1, wherein the blind hole in said valve member is larger in diameter than the diameter of the spring, said second end portion of the spring being engaged in the hole with clearance radially of the hole to provide a ball joint type of engagement.

4. A valve device as claimed in claim 1, wherein said spring includes a loop in the intermediate portion between said first and second end portions.

5. A valve device as claimed in claim 1, wherein said moveable valve member has a central portion facing toward said seat and having a finely and uniformly grooved surface serving to contact the end of a tube when inserted, and the central portion being surrounded by a peripheral lip projecting beyond said grooved surface to bear against said seat.

6. A valve device as claimed in claim 1, wherein said seal member comprises an elastomer having a base located inwardly of the aperture and supporting said seat, and said axial passage being cylindrical and of diameter smaller then said tube.

7. A valve device as claimed in claim 1, wherein said seal member comprises an elastomer having a base supporting said seat on one side of said aperture and having a rounded bead on the other side of said aperture, and said axial passage through the seal member widening out in the outward axial direction and constricting in the inward axial direction to seal against a tube when inserted.

8. A valve device as claimed in claim 1, wherein said movable valve member has a central portion facing toward said seat to contact the end of a tube when inserted, and the central portion being surrounded by a peripheral lip projecting behond said central portion and having an ogival cross-section providing an edge to bear against said seat.

* * * * *